US008443994B1

(12) United States Patent
Desselle

(10) Patent No.: US 8,443,994 B1
(45) Date of Patent: May 21, 2013

(54) TETHERED BOTTLE CAP ASSEMBLY WITH MEANS TO RETAIN A DETACHED CAP PORTION

(76) Inventor: Michael C. Desselle, Cypress, TX (US)

( * ) Notice: Subject to any disclaimer, the term of this patent is extended or adjusted under 35 U.S.C. 154(b) by 280 days.

(21) Appl. No.: 12/877,936

(22) Filed: Sep. 8, 2010

Related U.S. Application Data

(60) Provisional application No. 61/240,972, filed on Sep. 9, 2009.

(51) Int. Cl.
*B65D 55/16* (2006.01)

(52) U.S. Cl.
USPC ..... 215/306; 215/235; 215/317; 215/354; 215/355; 220/230; 220/288; 220/375; 24/302

(58) Field of Classification Search
USPC ..... 220/230, 288, 375; 215/235, 306, 215/317, 354, 355; 24/302
See application file for complete search history.

(56) References Cited

U.S. PATENT DOCUMENTS

| | | | | |
|---|---|---|---|---|
| 2,704,100 | A | 3/1955 | Freeman | |
| 3,306,483 | A | 2/1967 | Bellafiore | |
| 3,402,844 | A | 9/1968 | Chin | |
| 5,244,106 | A | 9/1993 | Takacs | |
| 2006/0249471 | A1 | 11/2006 | Leposavic et al. | |
| 2008/0142466 | A1 | 6/2008 | Balitski | |
| 2009/0134112 | A1 | 5/2009 | Reeves | |
| 2009/0152231 | A1 | 6/2009 | Hanson | |
| 2009/0301990 | A1 * | 12/2009 | Cresswell et al. | 215/344 |

* cited by examiner

*Primary Examiner* — Anthony Stashick
*Assistant Examiner* — Elizabeth Volz
(74) *Attorney, Agent, or Firm* — Andrew W. Chu; Craft Chu PLLC

(57) ABSTRACT

The present invention is a bottle cap assembly including an anchor, a cap portion, and a retaining device. The anchor attaches to a bottle and has a threaded neck and a ridge extending outward from the threaded neck. The cap portion removably attaches to the anchor and the bottle. The cap portion has a retaining sleeve along an entire circumference of the cap portion. The retaining device keeps the cap portion connected to the anchor, so that the cap portion is not lost. The retaining device includes a rod element housed in the retaining sleeve, and the rim of the retaining sleeve prevents detachment of the rod element from the retaining sleeve. The rod element extends between the anchor and cap portion, while only the anchor remains attached to the bottle.

19 Claims, 6 Drawing Sheets

TETHERED BOTTLE CAP ASSEMBLY WITH MEANS TO RETAIN A DETACHED CAP PORTION

RELATED U.S. APPLICATIONS

The present application claims priority under U.S. Code Section 119(e) from a provisional patent application, U.S. Patent Application No. 61/240,972, filed on 9 Sep. 2009 and entitled "BOTTLE CAP ASSEMBLY WITH MEANS TO RETAIN A DETACHED CAP PORTION".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a bottle cap assembly for bottles required to alternate between being open and closed during use, such as a small water bottle. More particular, the present invention relates to a bottle cap assembly with a retaining means for a detached cap portion of the bottle cap assembly. Additionally, the present invention also relates to the method of using the bottle cap assembly.

2. Description of Related Art Including Information Disclosed Under 37 CFR 1.97 and 37 CFR 1.98.

Bottled beverages and other bottle-type containers commonly use a disposable bottle cap assembly. The assembly seals the contents in the bottle until the bottle is opened for use. The bottle cap assembly includes a cap portion and an anchor portion. The cap portion unscrews from the bottle and detaches from the anchor portion, when the bottle is initially opened for use. To re-seal the bottle, the cap portion threadedly engages the top of the bottle again. The cap portion cannot re-attach to the anchor member. The bottle can be sealed and unsealed by the cap portion throughout the use of bottle, for example, until the entire liquid beverage is consumed.

As shown, in FIG. 1, the prior art bottle assembly 1 includes an anchor means 2 and a cap portion 3. The cap portion 3 unscrews from the threaded portion 5 of the bottle 4, and there is nothing to hold the cap portion 3. The cap portion 3 may be lost and easily separated from the anchor means 2 locked onto the bottle 4.

With the loose cap portion, the repeated sealing and unsealing increase the risk of misplacing the cap portion. The bottle cannot be sealed and unsealed without the cap portion. Another consequence of the loose cap portion is environmental pollution. The separation of the bottle and the cap portion is that the cap portion is less likely to be recycled with the bottle. Unlike the attached anchor member, the cap portion is no longer associated with the bottle. More people recycle the bottles after use, and the cap portion is forgotten. The number of discarded bottle caps can be a burden on the environment. Unlike pop-top cans with the pop tab attached to the can, the entire bottle assembly is not easily or routinely recycled.

In the past, various patents have been issued in the field of bottle caps. For example, U.S. Pat. No. 2,704,100 (the '100 patent), issued on Mar. 15, 1955 to Freeman teaches a bottle cap that has a means for storage and attachment of the cap when it is removed. The cap has a female connector, shown as reference numeral 20 in FIGS. 1 and 2, as an insert hole. A male connector, represented by reference numeral 15 as a protruding peg, extends outwardly from a position adjacent the top of the bottle.

U.S. Patent Publication No. 2009/0134112, published on May 28, 2009 to Reeves similarly discloses a baby bottle with a cap that is attachable to the side of the bottle. Referring to FIG. 1, it can be seen that the bottle has a male connector represented by reference numeral 51 extending outwardly from a side of the bottle. The bottle cap has a female connector, represented by reference numeral 52 extending from a top thereof. FIGS. 2A through 2D show various alternative embodiments of the male and female connectors.

U.S. Patent Publication No. 2009/0152231, published on Jun. 18, 2009 to Hanson also describes a bottle with a bottle cap holder positioned adjacent the top of the bottle. Female connectors, various embodiments of which are shown in FIGS. 1A through 1F, extend outwardly from the side of the bottle. The bottom, open portion of the bottle cap is received in the female connectors. The bottle cap may have a lip extending outwardly therefrom to ensure secure placement within the female connectors, as shown in FIG. 2A. The bottle cap is completely detached from the bottle for re-association with the female connector.

U.S. Pat. No. 3,306,483, issued on Feb. 28, 1967 to Bellafiore, describes an attachable captive cap device, wherein the cap is captured by an elastic tab with one end attached to the bottle. The cap is suspended from the tab for maintaining the cap with the bottle. The attachment to the cap includes a male connector on the top of the cap and a female connector on an end of the elastic tab. Similarly, the male-female attachment is again disclosed by the present invention.

U.S. Pat. No. 3,402,844, issued on Sep. 24, 1968 to Chin and U.S. Pat. No. 5,244,106, issued on Sep. 14, 1993 to Takacs, each disclose bottle assemblies to retain the removable cap portion. In both patents, the bottle has a cap-shaped cavity on the bottom of the bottle, so that the cap can be stored in this cavity when the bottle is opened for consumption of the contents.

Similarly, U.S. Publication No. 2008/0142466, published on Jun. 19, 2006, for Balitski and U.S. Publication No. 2006/0249471, published on Nov. 9, 2006 for Leposavic et al., each teach bottle assemblies to retain the removable cap portion in a cavity on the side of the bottle. The cavities are used to store the cap portions, when the bottle is open. The cavity is embedded into the shape of the bottle, and the cap portions are removably housed within such cavities.

It is an object of the present invention to provide a bottle cap assembly that retains a detached cap portion.

It is an object of the present invention to provide a bottle cap assembly that maintains the cap portion with the bottle during sealing and un-sealing of the bottle.

It is another object of the present invention to provide a removable and replaceable cap portion.

It is still another object of the present invention to provide a cap portion that can be twisted from the bottle for detaching without affecting the connection to the anchor of the bottle cap assembly.

These and other objects and advantages of the present invention will become apparent from a reading of the attached specification and appended claims.

SUMMARY OF THE INVENTION

The bottle cap assembly of the present invention includes an anchor means for attachment to a bottle, a cap portion removably attached to the anchor means and the bottle, and a retaining means for connecting the cap portion to the anchor means once separated. The anchor means has a threaded neck and a ridge extending outward from the threaded neck. The cap portion also has a retaining sleeve along an entire circumference thereof. Additionally, the cap portion has a threaded surface complementary to the threaded neck. The retaining means includes a rod element housed in the retaining sleeve, and there is a locking means to prevent detachment of the rod element from the retaining sleeve. The locking means on the rod can engage the rim of the retaining sleeve. The rod element is able to hinge at both ends so as to allow the cap portion to be moved away from the opening of the bottle.

The present invention also includes the method of anchoring a cap on a bottle. The method includes attaching an anchor and cap portion to the bottle, separating the anchor and the cap portion removably attached to the anchor means, unscrewing the threaded surface of the cap portion from the threaded neck of the bottle, and extending the rod element between the anchor and the cap portion. The retaining sleeve rotates over the rod element, during the unscrewing but does not release an end of the rod element. The cap portion can be separated from the bottle and re-attached by screwing the threaded surface back onto the threaded neck of the bottle. The method allows the bottle to be opened without losing the cap portion.

DETAILED DESCRIPTION OF THE DRAWINGS

Figure 1:
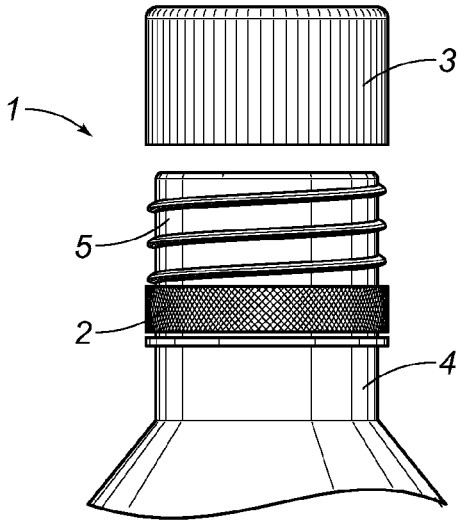
FIG. 1 Prior Art
FIG. 1 is an exploded schematic view of the prior art bottle cap assembly, showing a detached cap portion.
Figure 2:
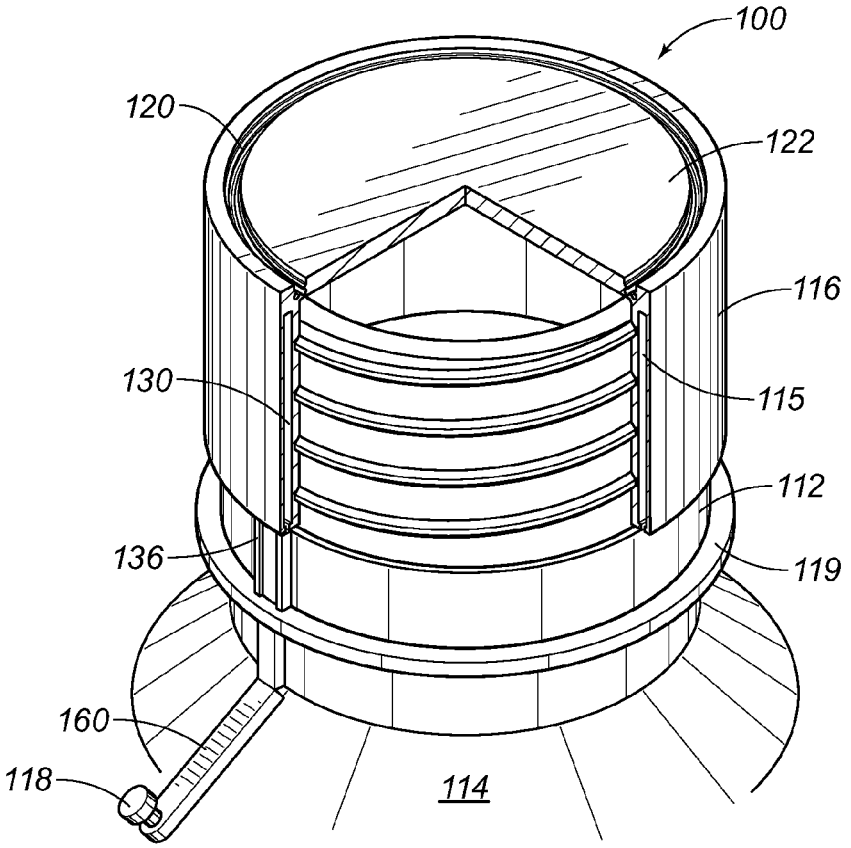
FIG. 2 is a partial cross-sectional and schematic view of the assembly of the present invention.
Figure 3:
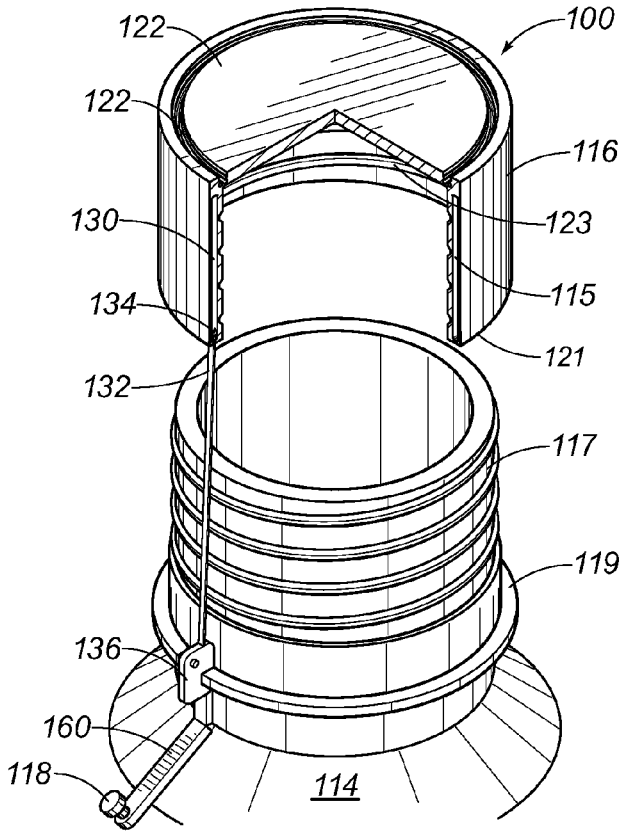
FIG. 3 is another partial cross-sectional and schematic view of the assembly of the present invention, showing an extended position of the rod element.
Figure 4:
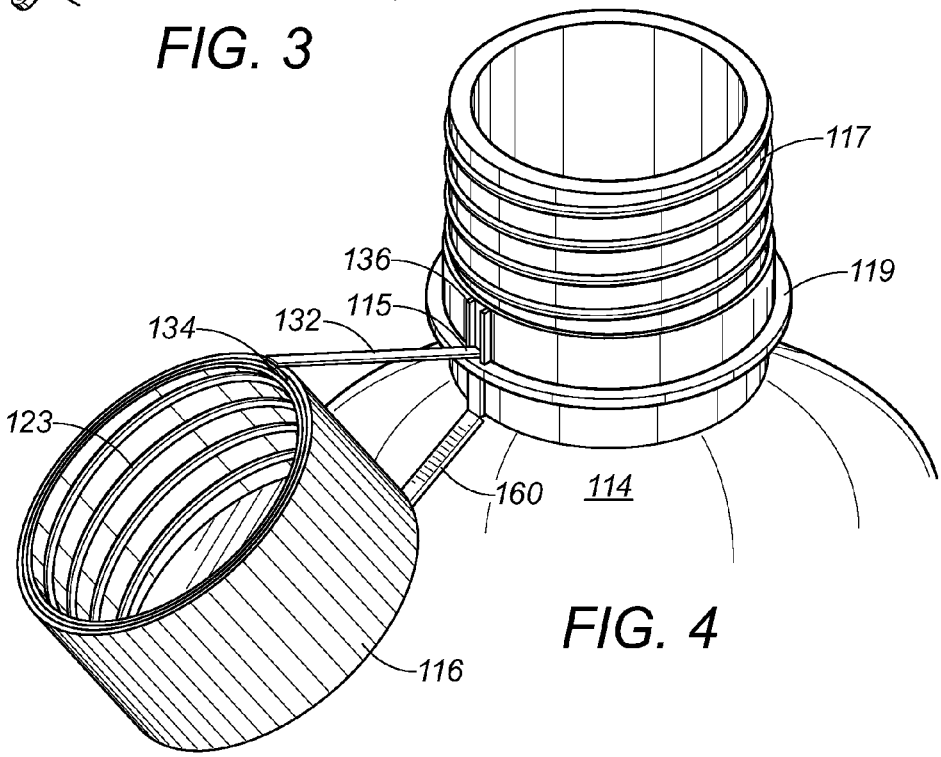
FIG. 4 is an elevation view of the assembly of the present invention, showing the hinging action of the rod element.

FIGS. 2-4 show the bottle cap assembly 100 with a retaining means 115 of the present invention. The bottle cap assembly 100 includes an anchor means 112 for attachment to a bottle 114, having a first connecting means 118 on an outer periphery thereof, and a cap portion 116 removably attached to the anchor means 112. The cap portion 116 has a second connecting means 120 at a top surface 122 of the cap portion 116. The anchor means 112 attaches to a bottle 114 with a threaded neck 117 and a ridge 119 extending outward from the threaded neck 117. FIGS. 2-4 show an embodiment with the tab 160 extending downward from the anchor means 112.

As shown in FIGS. 2-4, the cap portion 116 is comprised of a retaining sleeve 130 along an entire circumference of the cap portion 116. The retaining sleeve 130 is made integral with the cap portion 116 and has a rim 121. The retaining means 115 is for permanent attachment of the cap portion 116 and the anchor means 112, even though the cap portion 116 can be detached at the rim 121 from the anchor means 112. The cap portion 116 has complementary screw threads 123 to removably engage the threaded neck 117 of the bottle 114.

Figure 6:
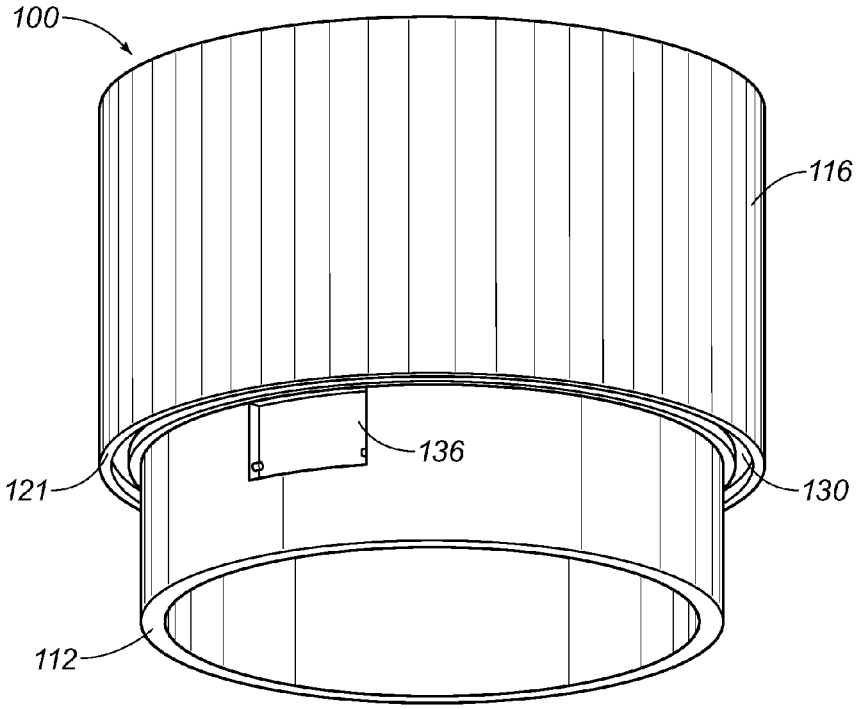
FIGS. 6 and 7 are lower perspective views of the assembly of the present invention, FIG. 6 showing the cap portion with the rod element and FIG. 7 showing the cap portion without the rod element.
Figure 8:
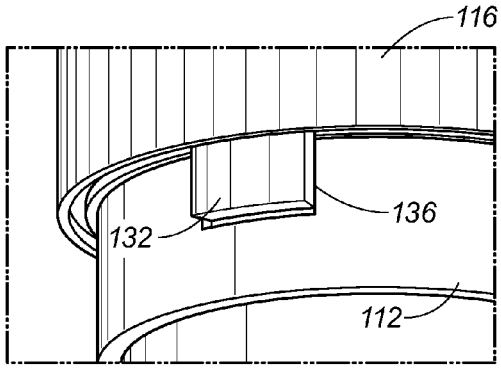
FIGS. 8 and 9 are an exploded perspective view of the anchor, showing a hinge means for attachment of the rod element with the rod attached in FIG. 7 and detached in FIG. 8.

The retaining means 115 includes a rod element 132 housed in the retaining sleeve 130, being generally flexible and straight. The rod element 132 extends into the retaining sleeve 130 when the cap portion 116 is sealed onto the bottle 114, both before and after separating from the anchor means 112. The rod element 132 is mounted on the anchor means 112 and housed within the retaining sleeve 130 as the retaining sleeve 130 remains rotatable over and around the rod element 132, when the cap portion 116 is screwed on and screwed off the neck 117 of the bottle. The rod element 132 is slidable within the retaining sleeve 130 such that the rod element can be shaped in any compatible form with the retaining sleeve. FIGS. 2 and 3 show a thin rod; FIG. 4 shows a plank shape; and FIGS. 6 and 8 show a thicker rod element as a block member. In any case, the rod element must be able to slide through the retaining sleeve 130, when the retaining sleeve 130 is threaded onto the bottle 114.

Figure 5:
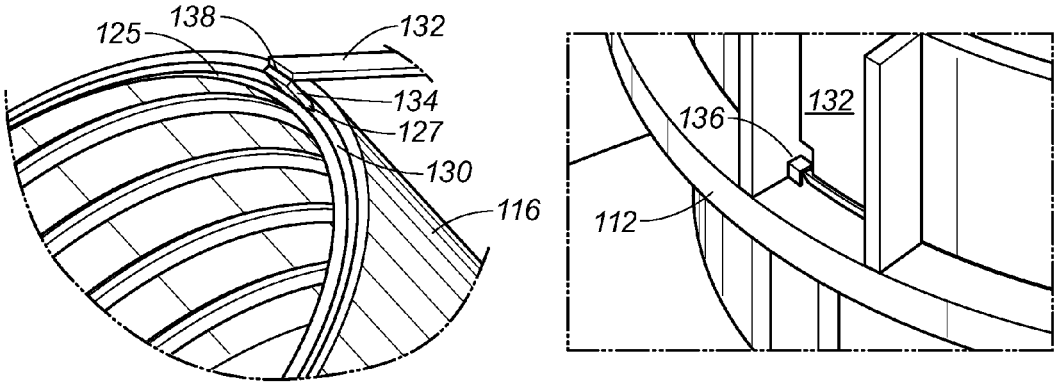
FIG. 5 shows two schematic views of types of hinges for the retaining means of the present invention.
Figure 7:
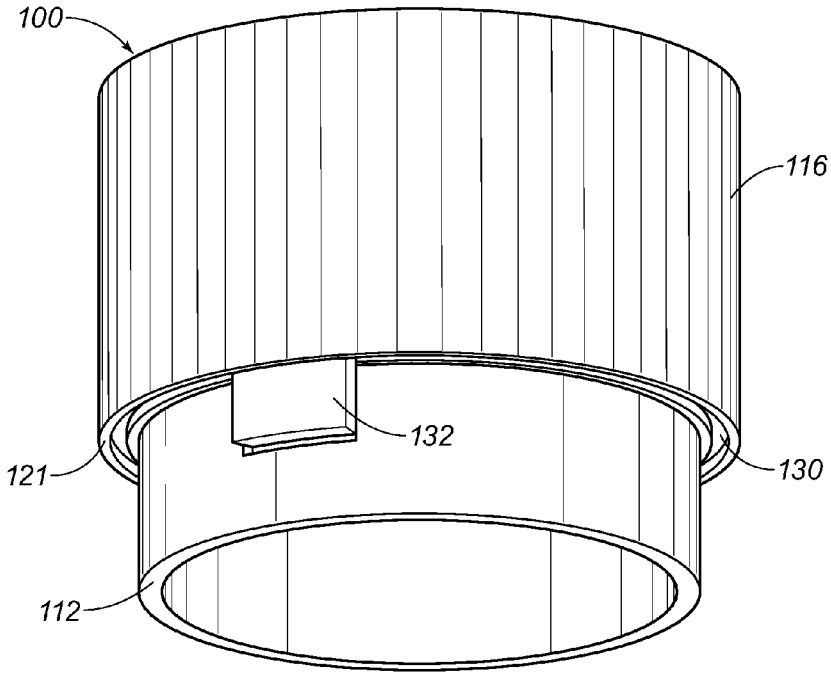

The retaining means 115 also includes a locking means 134 to prevent detachment from the retaining sleeve 130 at an end of the rod element 132. Any known attachment, such a friction-fit, can be used to lock the end of the rod element 132 into the retaining sleeve 130. In particular, the rim 121 of the retaining sleeve 130 can have an abutment member 125, as shown in FIG. 5. The abutment member 125 narrows an opening of the retaining sleeve 130, and rod element 132 has a protrusion 127 on an end thereof. The protrusion 127 engages the abutment member 125 so as to prevent the end of the rod element 132 from exiting the retaining sleeve 130. FIGS. 6 and 7 also show this rim 121 with the abutment member or flanged wall extended to narrow the retaining sleeve 130.

Figure 9:
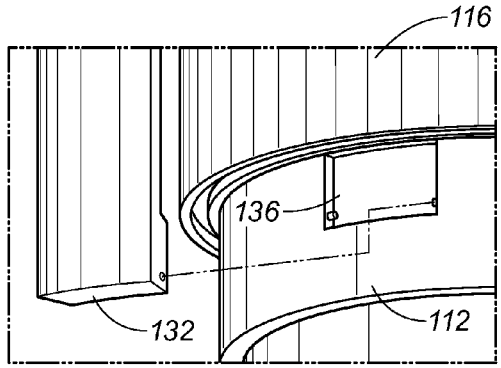
Figure 13:
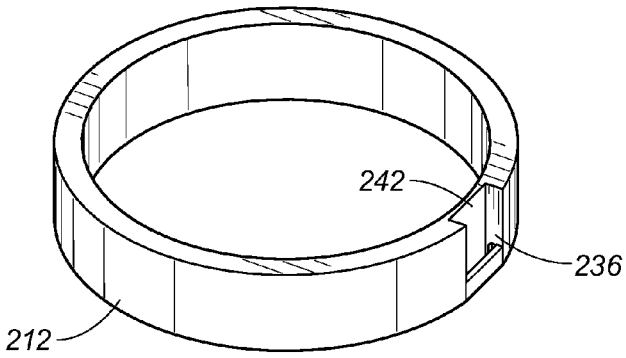
FIGS. 13-15 are exploded perspective views of the first hinging means, showing two upper and one lower perspective views.
Figure 14:
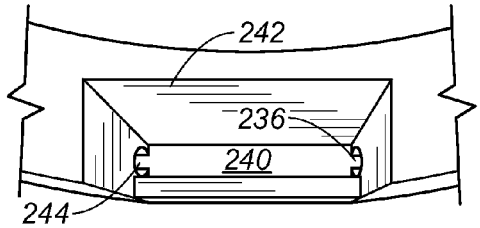
Figure 15:
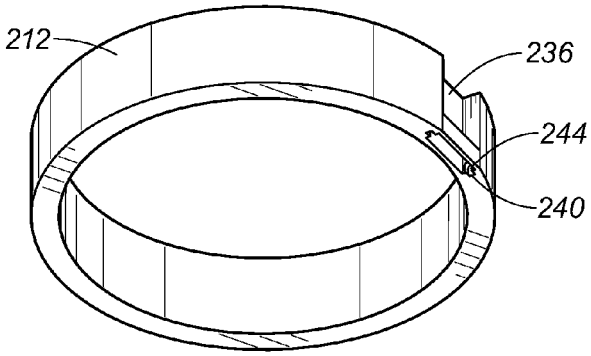

There is also a first hinging means 136 pivotally connected to the anchor means 112. FIGS. 3-6 each show different versions of hinging means for this pivotal connection between the retaining means 115 and the anchor means 112. FIGS. 13 to 15 also show a hinging means 236 of the present invention. A second hinging means 138 in FIG. 5 pivotally connects between the locking means 134 and the rod element 132. The hinging means 136 and 138 work cooperatively to separate the cap portion from the bottle opening, so that the contents can pour from the bottle 114. FIGS. 8 and 9 show that the rod element 132 is detachable from the anchor member 112 for final disposal of the bottle 114. This invention reduces the risk of losing or misplacing the cap portion 116 after initially unsealing the bottle 114.

Figure 10:
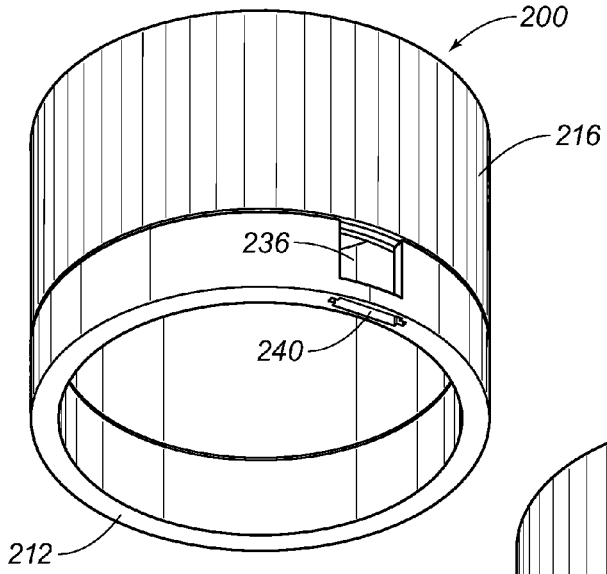
FIGS. 10-12 are perspective views of another embodiment of the assembly of the present invention, showing a thicker rod element and first hinging means.
Figure 11:
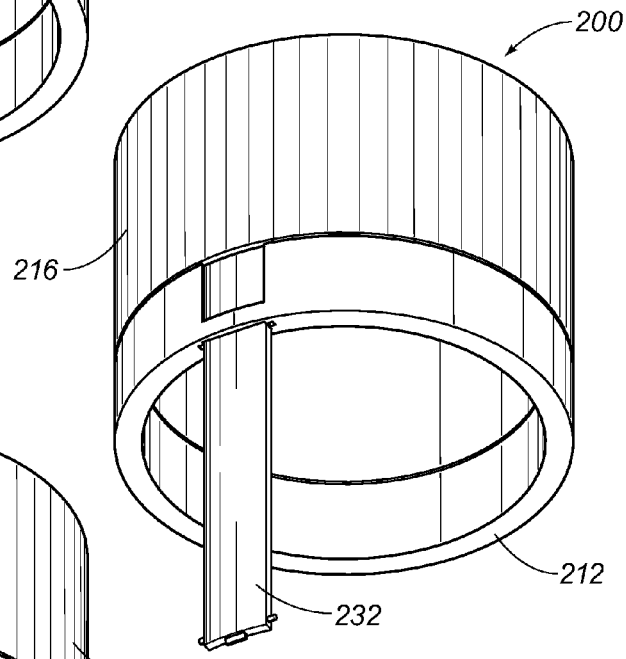
Figure 12:
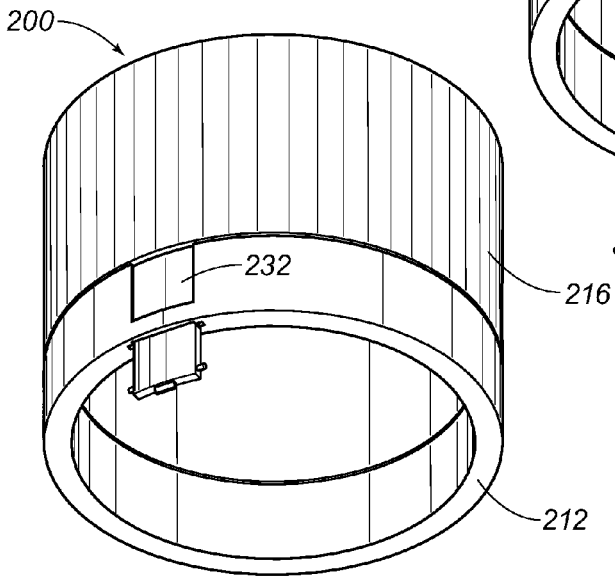

Another embodiment 200 of the first hinging means 236 is shown in FIGS. 10-16. FIGS. 10-12 show the first hinging means on a thick anchor means 212, being a hollowed cavity for engaging the rod element 232. The first hinging means 236 has a bottom slot 240 for installing the rod element 232, wherein the rod element 232 slides through the bottom slot of the anchor means 212 and into the retaining sleeve 230. The rod element 232 passes through the bottom slot 240 until the rod element 232 engages the first hinging means 236. The structure allows for easy assembly and alignment of the anchor means 212 and cap portion 216 unlike the prior art.

Even when multiple parts need to be combined, the present invention provides a most efficient and easy installation structure. The anchor means 212 is shown to be thicker and sturdier than in other versions. The sonic seal between the anchor means 212 and the rim 221 of the cap portion 216 remains breakable for detachment. FIGS. 10-12 show the installation process of the assembly 200. With separately molded parts, the ease of assembly and insuring alignment within the retaining sleeve 230 are particular concerns of the present invention.

Figure 16:
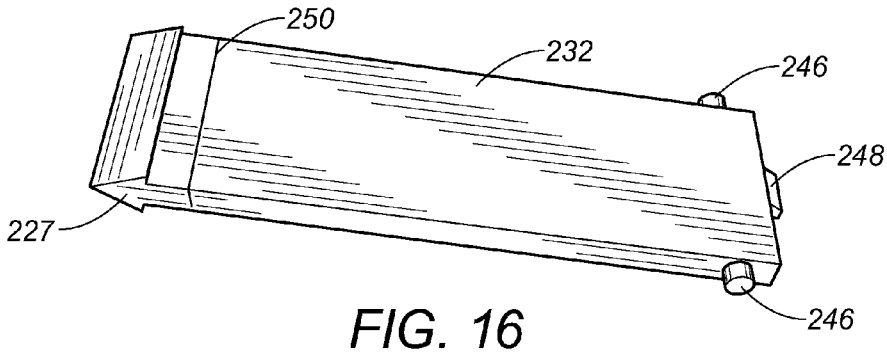
FIG. 16 is a perspective view of the rod element of the present invention shown in FIGS. 10-15.

FIGS. 13-15 show a more detailed view of the first hinging means 236. The hollow cavity 242 is generally rectangular with height, depth, and width to fit the rod element 232 and the anchor means 212. The cavity 242 is open at the top of the anchor means 212 so that the rod element 232 can extend straight through to the retaining sleeve 230. There are also pivot holes 244 for snap-fit engagement of the rod element 232. The bottom slot 240 is shown on the lower perspective views of the anchor means 212 for installing the rod element 232 by sliding through the bottom slot 240. The pivot holes 244 are on opposite ends of the first hinging means 236 to define the pivot point of the rod element 236. The rotational action at the first hinging means 236 allows the cap portion to be moved from the mouth of the bottle for unobstructed access to the contents of the bottle. FIG. 16 shows the rod element 232 according to this embodiment 200. The rod element 232 has a protrusion 227 as an arrowhead shape, which similarly engages the abutment member or flanged wall on the rim 221 of the cap portion 216. Rod element 232 further shows a set of pegs 246 on each side of the rod element 232 and a lock 248 at a distal end of the rod element 232. The pegs 246 removably engage the pivot holes 244 of the first hinging means 236, so that the pegs 246 rotate within the pivot holes 244. The lock 248 is an angled protrusion, which also pivots with the rod element 232. The lock 248 is snap fit into the cavity 242 to hold the position of the rod element 232 and cap portion away from the mouth of the bottle. The angle of the surface of the lock 248 determines the angle of rod element 232, away from the vertical alignment shown in FIGS. 11 and 12. The lock 248 clears the cap portion from the bottle for dispensing the contents of the bottle without interference. FIG. 16 also shows a possible version of the second hinging means 250 as a perforated or half severed tip before the protrusion. The rod element 232 can bend at the perforation to pivot the cap portion from the rod element 232.

The present invention also includes the method for anchoring a cap on a bottle, using the assembly of FIGS. 1-9. The method includes the step of attaching an anchor 112 and cap portion 116 to a bottle 114. The bottle 114 has a ridge 119 extending outward from a threaded neck 117 of the bottle, and the cap portion 116 has a threaded surface 123 to engage the threaded neck 117 of the bottle 114. The retaining sleeve 130 is placed along an entire circumference of the cap portion 116 and houses a rod element 132, being generally flexible and straight. Next, the anchor 112 and the cap portion 116 are separated at the rim 121 of the retaining sleeve.

Once freed from the anchor 112, the cap portion 116 is able to unscrew the threaded surface 123 from the threaded neck 117. The retaining sleeve 130 rotates around the rod element 132, which slides through the retaining sleeve 130. The rode element 132 extends between the anchor 112 and the cap portion 116 as shown in FIG. 3, separating the cap portion 116 further from the bottle 114. Now, the contents of the bottle can be dispensed or poured from the opening. The method also includes screwing the threaded surface 123 of the cap portion 116 back onto the threaded neck 117 of the bottle 114, after the cap portion 116 and the bottle 114 are separated and after the cap portion 116 and the anchor 112 are separated at the rim 119. The bottle 114 can be sealed and re-sealed without losing the cap portion 116.

The rod element 132 must be aligned to the retaining sleeve 130, so that the rod element 132 is properly housed within. This sliding engagement must be preserved whenever the cap portion 116 engages the threaded neck 117 of the bottle 114 in either opening or closing the bottle 114. The permanent attachment of the cap portion 116 is achieved by engaging an end of the rod element 132 with the rim 121 of the retaining sleeve 130, the end of the rod element 132 being opposite an end attached to the anchor 112. For example, the rim 121 of the retaining sleeve 130 has an abutment member 125 narrowing an opening of the retaining sleeve, and the rod element 132 has a protrusion 127 on an end thereof. The protrusion 127 engages the abutment member 125 so as to prevent the end of the rod element 132 from exiting the retaining sleeve 130. Other locking methods are also possible in the present invention.

Another part of the method of anchoring the cap includes hinging the rod element 132 at the anchor 112. The cap portion 116 can be moved away from the opening of the bottle 114 to avoid obstructions of the contents pouring from the bottle 114. Additionally, the rod element 132 can hinge at the cap portion 116 as well, which provides further flexibility for moving the cap portion 116 away from the mouth of the bottle 114. FIG. 9 show a final disposal step of detaching the rod element 132 from the anchor 112. Once used, the bottle and all parts can be disposed, after being separated from the bottle 114.

The present invention provides a bottle cap assembly that retains a detached cap portion. The cap portion is stored on the bottle during sealing and un-sealing of the bottle. The risks of losing or misplacing the cap portion are significantly reduced. The ease of opening and closing the bottle is also increased because the user does not have store and search for the cap portion separately. Additionally, the particular cap portion of the present invention can be rotated in any direction for screwing engagement to the bottle, while maintaining the rod element connection to the bottle. The cap portion is removable and re-attachable to the bottle. The connection can be fast and efficient. Additionally, the cap portion can be twisted from the bottle for detaching without affecting the connection to the anchor of the bottle cap assembly. Thus, the retaining means provides a permanent attachment of the cap portion to the anchor means to reduce the risk of misplacing the cap portion.

The foregoing disclosure and description of the invention is illustrative and explanatory thereof. Various changes in the details of the illustrated construction and method can be made without departing from the true spirit of the invention. The present invention should only be limited by the disclosure and the specification. The present invention should only be limited by the following claims and their legal equivalents.

I claim:

1. A bottle cap assembly comprising:

an anchor means for attachment to a bottle having a ridge extending outward from a threaded neck of said bottle;

a cap portion being removably attached to said anchor means and having a retaining sleeve along an entire circumference of said cap portion, said retaining sleeve having a rim; and a retaining means for attachment of said cap portion to said anchor means, wherein said retaining means comprises:

a rod element housed in said retaining sleeve, being generally flexible and straight; and a locking means to prevent detachment from said retaining sleeve at an end of said rod element, said locking means engaging said rim of said retaining sleeve.

2. The bottle cap assembly of claim 1, wherein said anchor means is comprised of a ring member with a locking means onto said bottle, said locking means being comprised of a plurality of inverted angle pins pointed inward from a perimeter of said ring member, said ring member having a diameter smaller than said ridge, said inverted angle pins engaging screw threads of said threaded neck so as to lock said anchor means in place.

3. The bottle cap assembly of claim 1, wherein said cap portion has complementary screw threads removably engaging said threaded neck of said bottle.

4. The bottle cap assembly of claim 1, wherein said rod element is mounted on said anchor means and housed within said retaining sleeve, when the cap portion is attached to said bottle.

5. The bottle cap assembly of claim 1, wherein said rod element is mounted on said anchor means and housed within said retaining sleeve, said retaining sleeve being rotatable around said rod element when the cap portion is screwed on and screwed off the neck of said bottle.

6. The bottle cap assembly of claim 1, wherein said rim of said retaining sleeve has an abutment member narrowing an opening of said retaining sleeve, said rod element having a protrusion on an end thereof, said protrusion engaging said abutment member so as to prevent said end of said rod element from exiting said retaining sleeve.

7. The bottle cap assembly of claim 1, wherein said rod element is slidable within said retaining sleeve, said rod element having a shape compatible with said retaining sleeve.

8. The bottle cap assembly of claim 1, further comprising:

a first hinging means pivotally connecting said rod element to said anchor means; and a second hinging means pivotally connecting an opposite end of said rod element to said locking means, wherein said cap portion is separable from said bottle and attached to said anchor means through said rod element.

9. The bottle cap assembly of claim 8, wherein said first hinging means is detachable from said anchor means.

10. The bottle cap assembly of claim 8, wherein said first hinging means is comprised of a hollowed cavity, a bottom slot, and a plurality of pivot holes, said rod element passing through said bottom slot into said retaining sleeve of said cap portion and being housed with said hollowed cavity, said rod element removable engaging said pivot holes.

11. The bottle cap assembly of claim 10, wherein said rod element is comprised of a protrusion, a plurality of pegs on each side of said rod element, and a lock, said protrusion being engageable to said abutment member of said rim, said plurality of pegs being snap fit into said pivot holes of said first hinging means respectively, said lock having an angled surface for snap fit engagement to said hollowed cavity so as to set an angle of said rod element away from said anchor means.

12. A method for anchoring a bottle cap assembly of claim 1 on a bottle, the method comprising the steps of:

attaching an anchor and cap portion to said bottle, said bottle having a ridge extending outward from a threaded neck of said bottle, said cap portion having a threaded surface to engage said threaded neck of said bottle and a retaining sleeve along an entire circumference of said cap portion, said retaining sleeve housing a rod element, being generally flexible and straight;

separating said anchor and said cap portion removably attached to said anchor means;

unscrewing said threaded surface of said cap portion from said threaded neck of said bottle, said retaining sleeve rotating around said rod element; and extending said rod element between said anchor and said cap portion, said cap portion being separated from said bottle.

13. The method for anchoring a cap on a bottle, according to claim 12, further comprising the step of:

detaching said rod element from said anchor.

14. The method for anchoring a cap on a bottle, according to claim 12, further comprising the step of:

screwing said threaded surface of said cap portion onto said threaded neck of said bottle, after said cap portion and said bottle are separated.

15. The method for anchoring a cap on a bottle, according to claim 14, further comprising the step of:

aligning said rod element to said retaining sleeve; and housing said rod element within said retaining sleeve as the cap portion engages the threaded neck of said bottle.

16. The method for anchoring a cap on a bottle, according to claim 12, further comprising the step of:

engaging an end of said rod element with a rim of said retaining sleeve, said end of said rod element being opposite an end attached to said anchor.

17. The method for anchoring a cap on a bottle, according to claim 16, wherein said rim of said retaining sleeve has an abutment member narrowing an opening of said retaining sleeve, said rod element having a protrusion on an end thereof, said protrusion engaging said abutment member so as to prevent said end of said rod element from exiting said retaining sleeve.

18. The method for anchoring a cap on a bottle, according to claim 12, further comprising the step of:

hinging said rod element at said anchor, said cap portion being separated from said bottle.

19. The method for anchoring a cap on a bottle, according to claim 18, further comprising the step of:

hinging said rod element at said cap portion.

* * * * *